US009132634B2

(12) United States Patent
Melde

(10) Patent No.: US 9,132,634 B2
(45) Date of Patent: Sep. 15, 2015

(54) BYPASS FLOW PATH FOR INK JET BUBBLES

(71) Applicant: Palo Alto Research Center Incorporated, Palo Alto, CA (US)

(72) Inventor: Kai Melde, San Francisco, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 97 days.

(21) Appl. No.: 13/688,769

(22) Filed: Nov. 29, 2012

(65) Prior Publication Data

US 2014/0146110 A1 May 29, 2014

(51) Int. Cl.
*B41J 2/19* (2006.01)
*B41J 2/14* (2006.01)

(52) U.S. Cl.
CPC ..... *B41J 2/14024* (2013.01); *B41J 2/19* (2013.01)

(58) Field of Classification Search
USPC ..... 347/89, 86, 65–70, 42
See application file for complete search history.

(56) References Cited

U.S. PATENT DOCUMENTS

| | | | | |
|---|---|---|---|---|
| 4,835,554 | A * | 5/1989 | Hoisington et al. | 347/94 |
| 4,891,654 | A * | 1/1990 | Hoisington et al. | 347/40 |
| 5,138,344 | A * | 8/1992 | Ujita | 347/86 |
| 8,684,507 | B2 * | 4/2014 | Uezawa | 347/89 |
| 2008/0158304 | A1 * | 7/2008 | Eto | 347/65 |
| 2010/0187667 | A1 * | 7/2010 | Hoisington et al. | 257/678 |
| 2011/0242236 | A1 * | 10/2011 | Uezawa | 347/89 |
| 2014/0022313 | A1 * | 1/2014 | Gao et al. | 347/61 |

FOREIGN PATENT DOCUMENTS

| | | |
|---|---|---|
| EP | 2305472 | 4/2011 |
| JP | 36116865 | 1/1986 |
| JP | 401145156 | 6/1989 |
| JP | 406143565 | 5/1994 |
| WO | WO2011080115 | 7/2011 |

OTHER PUBLICATIONS

Choi et al., "Bubbles navigating through networks of microchannels," Lab Chip, 2011, 11 3970-3978.

* cited by examiner

*Primary Examiner* — Matthew Luu
*Assistant Examiner* — Lily Kemathe
(74) *Attorney, Agent, or Firm* — Hollingsworth Davis, LLC

(57) ABSTRACT

An apparatus includes a bypass flow path between an ink supply port and a vent port and a primary flow path between the ink supply port and an ink delivery port. A first flow velocity of the bypass flow path is higher than a second flow velocity of the primary flow path. The first flow velocity induces bubbles to travel via the bypass flow path instead of the primary flow path.

12 Claims, 7 Drawing Sheets

BYPASS FLOW PATH FOR INK JET BUBBLES

BACKGROUND

Ink jet printers operate by ejecting small droplets of liquid ink onto print media according to a predetermined pattern. In some implementations, the ink is ejected directly on a final print media, such as paper. In other implementations, the ink is ejected on an intermediate print media, e.g. a print drum, and is then transferred from the intermediate print media to the final print media. Some ink jet printers use cartridges of liquid ink to supply the ink jets. Some printers use phase-change ink which is solid at room temperature and is melted before being jetted onto the print media surface. Phase-change inks that are solid at room temperature allow the ink to be transported and loaded into the ink jet printer in solid form, without the packaging or cartridges typically used for liquid inks

SUMMARY

Examples described herein are directed to an ink jet manifold. In one embodiment, an apparatus includes a bypass flow path between an ink supply port and a vent port and a primary flow path between the ink supply port and an ink delivery port. A first flow velocity of the bypass flow path is higher than a second flow velocity of the primary flow path. The first flow velocity induces bubbles to travel via the bypass flow path instead of the primary flow path. The apparatus may include a heater configured to induce a first temperature in the bypass flow path that is higher than a second temperature of the primary flow path. In such a case, the first temperature reduces a viscosity of ink flowing in the first path such that the first flow velocity of the bypass flow path is higher than the second flow velocity of the primary flow path.

In another embodiment, a method involves activating a heater proximate to a bypass channel of an ink delivery path way. A purge operation is initiated that causes ink to flow through the bypass channel and through a primary channel of the ink delivery pathway. The heater causes ink to flow at a higher velocity through the bypass channel than through the primary channel, and the higher velocity induces bubbles in the ink to flow through the bypass channel instead of the primary channel.

In another embodiment, an apparatus includes a plurality of stacked layers. Cutouts of the layers form: an inlet port coupled to an ink source; an exit port coupled to an ink delivery element; a vent port; a bypass flow path between the inlet port and the vent port; and a primary flow path between the inlet port and the exit port. A first flow velocity of the bypass flow path is higher than a second flow velocity of the primary flow path. The first flow velocity induces bubbles to travel via the bypass flow path instead of the primary flow path.

These and other features and aspects of various embodiments may be understood in view of the following detailed discussion and accompanying drawings.

BRIEF DESCRIPTION OF THE DRAWINGS

The discussion below makes reference to the following figures, wherein the same reference number may be used to identify the similar/same component in multiple figures.

DETAILED DESCRIPTION

Figure 1:
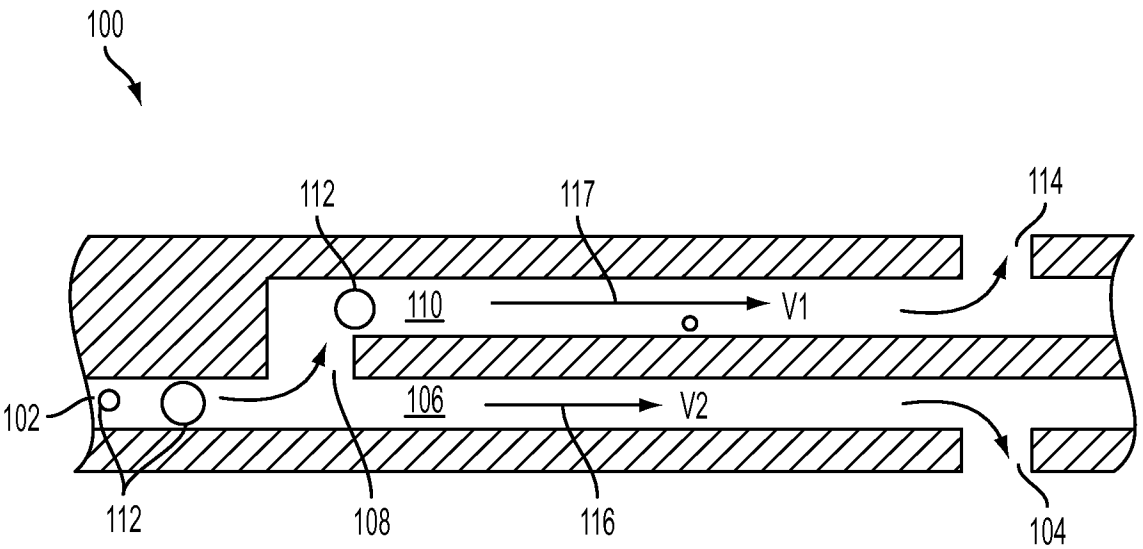
FIG. 1 is a schematic diagram of an inkjet manifold flow path according to an example embodiment.

The present disclosure relates to inkjet printing devices. Ink jet printers operate by ejecting small droplets of liquid ink onto print media according to a predetermined pattern. In some implementations, the ink is ejected directly on a final print media, such as paper. In other implementations, the ink is ejected on an intermediate print media, e.g. a print drum, and is then transferred from the intermediate print media to the final print media. Some ink jet printers use cartridges of liquid ink to supply the ink jets. Some printers use phase-change ink which is solid at room temperature and is melted before being jetted onto the print media surface. Phase-change inks that are solid at room temperature allow the ink to be transported and loaded into the ink jet printer in solid form, without the packaging or cartridges typically used for liquid inks.

In a liquid state, ink may contain bubbles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that can be subsequently filled by air. When the solid ink melts prior to ink jetting, the air in the voids can become bubbles in the liquid ink.

Enclosed air (bubbles) in the fluid path of an ink jet print head can lead to temporary fail of jets due to temporary absence of ink or simply disturb the acoustic performance of the ink jet when trapped near the manifold. The formation of bubbles may be an issue for phase change inks, which may shrink by as much as 15% during freeze. The high forces associated with phase changes and the complex and often rigid channel geometries lead to voids caused by delamination, cracking and air leakage or outgassing of components. After thaw the voids become bubbles and mobilize and follow the ink flow towards the jets.

To ensure proper system performance, it is desirable to move bubbles away from the jets and eventually vent them out of the system. This is sometimes done with a purge: pushing enough ink volume through the print head until it is bubble free. The ink volume that is needed for a successful purge depends on locations of voids, path lengths and which paths the bubbles chose at intersections. A purge may be done after each on-off cycle when the print head is being warmed up.

The proposed embodiments use branching channel networks with variable fluidic resistance to guide bubbles along predetermined paths. At branching intersections, bubbles tend to follow the path with the higher flow rate or velocity. The exact bubble behavior depends on geometry but can be pre-determined during channel design. By arranging a network of parallel channels it is possible to guide bubbles to a final path that only accounts for a fraction of the total flow rate. This path can then lead to a vent or back to the ink reservoir.

Another way to achieve the desired difference in fluidic resistance of parallel channels is by using the temperature dependence of the ink's viscosity. One or more heater elements and separating layers of low thermal conductivity can be arranged in a way to impose a temperature gradient across the parallel channels which leads to a corresponding gradient in fluidic resistance. The heater element can be triggered by a bubble detection technique (capacitive, acoustic, or others) ahead of the branching point to activate the higher venting flow rate only when a bubble is present. Fracture of bubbles at intersections should not occur due to the small geometries and flow rates associated with ink jet flows.

Embodiments described in this disclosure utilize features to remove bubbles from ink flows before they reach critical components, such as narrow manifold passages, jets, etc. For purposes of the present discussion, the term "manifold" will be used to describe a fluid flow path between a source of ink (e.g., tank, reservoir) and a destination (e.g., jet, orifice). As a result, the embodiments are not intended to be limited to particular manifold embodiments, e.g., fluid paths with multiple input paths and/or multiple output paths. As described hereinbelow, the manifold may have at least one ink supply port coupled to an ink supply and at least one ink delivery port. A port may at least include any passageway, opening, orifice, permeable member, etc., that fluidly couples one ink passageway to another.

In reference now to FIG. 1, a schematic diagram illustrates an inkjet manifold flow path 100 according to an example embodiment. The flow path 100 includes an ink supply port 102 and an ink delivery port 104 fluidly coupled via an elongated, primary passageway 106. The ink supply port 102 is an inlet port coupled to an ink supply (e.g., reservoir) and the ink delivery port 104 is an exit port coupled to an ink delivery element (e.g., ink jet). A junction 108 couples the input port 102 and/or primary passageway 106 to a bypass passageway 110. The bypass passageway 110 transports bubbles 112 and (usually) ink to a vent port 114. The vent port 114 is an outlet that facilitates venting bubbles and fluid flowing through the bypass passageway 110.

Fluid flows between ink supply port 102 and both ink delivery port 104 and vent port 114 as indicated by arrows 116, 117. Also indicated by the relative sizes of arrows 116, 117, is that a flow velocity V1 in the bypass passageway 110 is higher than a flow velocity V2 in the primary passageway 106. It has been found that when a fluid flow containing bubbles 112 is split between two paths, the bubbles 112 will migrate to the path having the higher flow velocity, in this case bypass passageway 110. As a result, the passageways 106, 110 and/or surrounding structures are configured to ensure that the velocity V1 of passageway 110 is higher than a velocity V2 of passageway 106. It has been observed that this migration of the bubbles 112 to higher velocity channel 110 works reliably in cases where the size of the channel 110 is approximately the same as the size of the bubbles. This makes such a solution applicable to print heads, because in such an application, bubbles coalesce easily and the channels are relatively small. It is possible, however, that these mechanisms may work for smaller bubbles as well.

In this and other embodiments, the bypass passageway 110 may be selectably activated during a purging operation (or for other purposes), and de-activated at other times. In FIG. 1, for example, this may be accomplished by blocking or un-blocking the vent port 114 and/or junction 108. This may be accomplished by a mechanical flow blocking member (e.g., valve, gate, actuator) or using other flow blocking techniques (e.g., cooling part of the path so that ink solidifies and blocks the path). It will be understood that the bypass passageway 110 may be enabled at all times in some configuration, including during device operation. For example, if fluid passing through the vent port 114 can be recovered for use after bubbles have settled out, then the bypass may be used during operation. In other configurations, the bypass may be selectively enabled if needed, e.g., if bubbles are detected upstream from inlet port 102. This selective enabling can also be performed during a purge operation, such that the bypass is only active for part of the purge operation.

Figure 2:
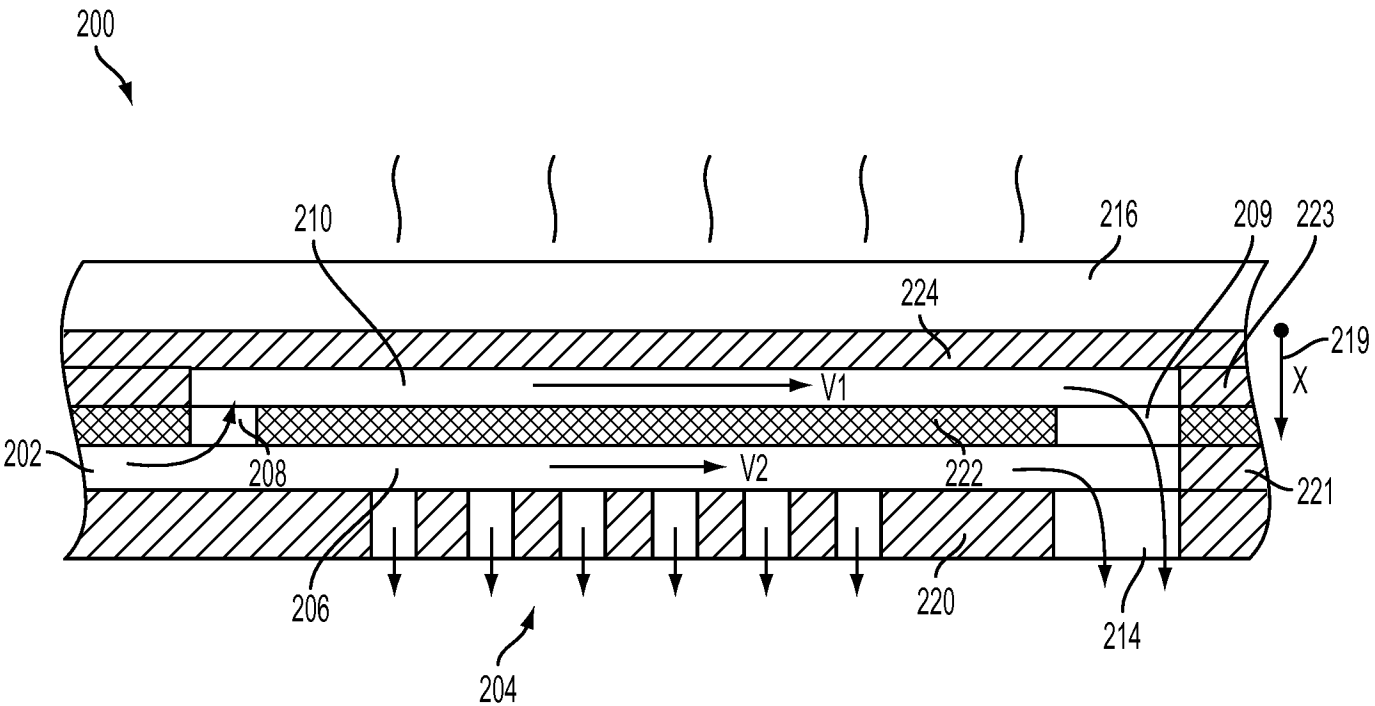
FIG. 2 is a schematic diagram of an inkjet manifold flow path using a heater according to an example embodiment.

In reference now to FIG. 2, a schematic diagram illustrates an inkjet manifold flow path 200 that uses heat to cause different flow velocities in passageways according to an example embodiment. The flow path 200 includes an ink supply port 202 and a plurality of ink delivery ports 204 (e.g., exit ports) fluidly coupled via a primary channel 206. A junction 208 couples the input port 202 and/or primary channel 206 to a bypass channel 210. Both the primary and bypass channels 206, 210 are coupled to a vent port 214. The bypass channel 210 diverts bubbles away from the primary flow path to the vent port 214.

A heater 216 (e.g., a resistive heater that may be made of Cr—Ni) is thermally coupled proximate to the venting passageway 210. This induces a thermal gradient along the flow path 200 such that ink in the bypass channel 210 has a higher temperature than ink in the primary channel 206. The heat reduces the viscosity of the ink such that, if other flow parameters of the channels 210, 206 are similar (e.g., length, cross sectional area, surface roughness), then fluid will flow faster through the path having the higher temperature. This is indicated in FIG. 2 with velocity V1 of the bypass channel 210 having a higher magnitude than velocity V2 of the primary channel 206.

It will be appreciated that alternate devices or structures may be used to induce a relative temperature differential between channels 206 and 210. For example, if a heat source uniformly heats structures surrounding the flow path 200, then cooling source (e.g., heat sink, heat pipes, cooling elements) may be positioned proximate the primary channel 206 so that the ink flowing through the primary channel 206 has a lower temperature than ink flowing through bypass channel 210.

The channels 206, 210 in FIG. 2 may be substantially planar, e.g., formed from parallel layers of material with cutouts between facing surfaces forming the channels 206, 210. In one example structure, the flow path 200 may be formed from a bottom layer 220 of stainless steel through which vias are formed to create the delivery ports 204 and vent port 214. A stainless steel channel layer 221 has a cutout that forms the supply port 202 and primary channel 206. A resistance layer 222 may be formed from a polymer (e.g., polyimide) and separates the primary and bypass channels 206, 210. The resistance layer 222 acts as a thermal insulator that helps to increase the temperature difference between the channels 206, 210.

The resistance layer 222 includes a via that forms the junction 208 as well as a via 209 that couples the bypass channel 210 to the vent port 214. A bypass channel layer 223 may be made from stainless steel, and has a cutout that forms the bypass channel 210. An optional top layer 224 may be used to separate the bypass channel 210 from the heater 216. The top layer 224 may be relatively thin and/or have a high coefficient of thermal conductance in order to effectively transfer heat from the heater 216 to fluid flowing within bypass channel 210. Alternatively, the heater 216 may be used to seal the bypass channel 210 directly.

Figure 3:
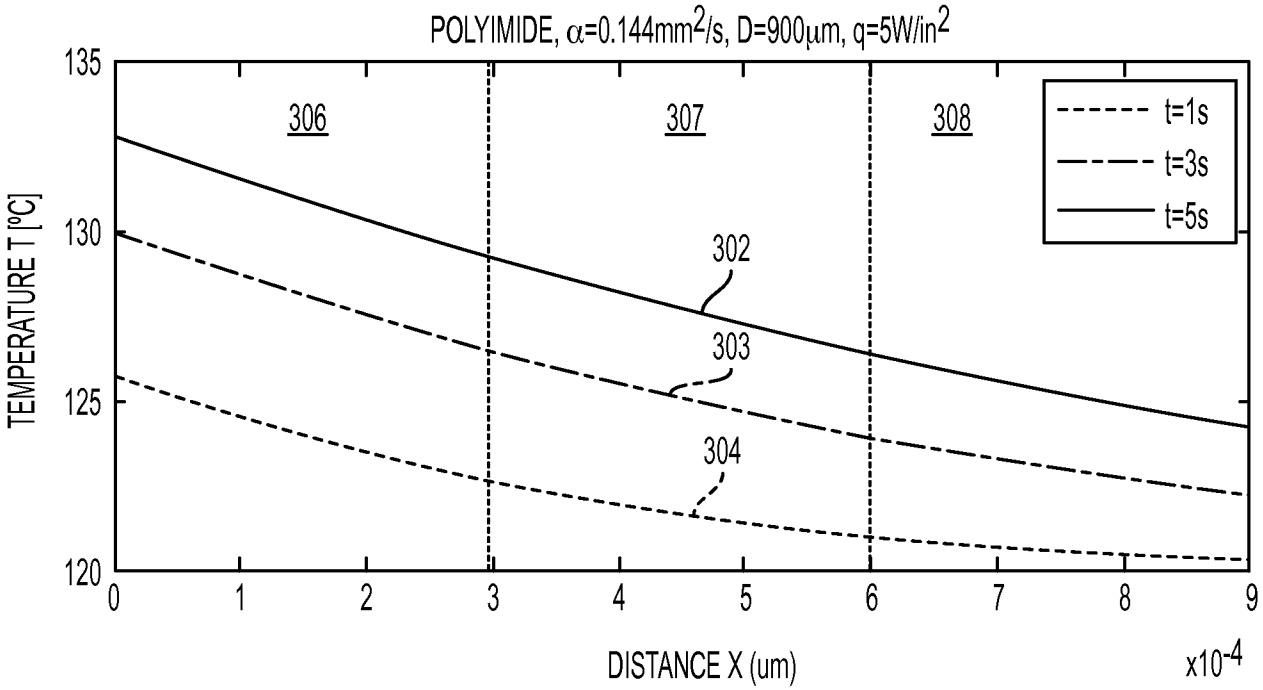
FIGS. 3 and 4 are graphs illustrating thermal analyses of example flow path embodiments.
Figure 4:
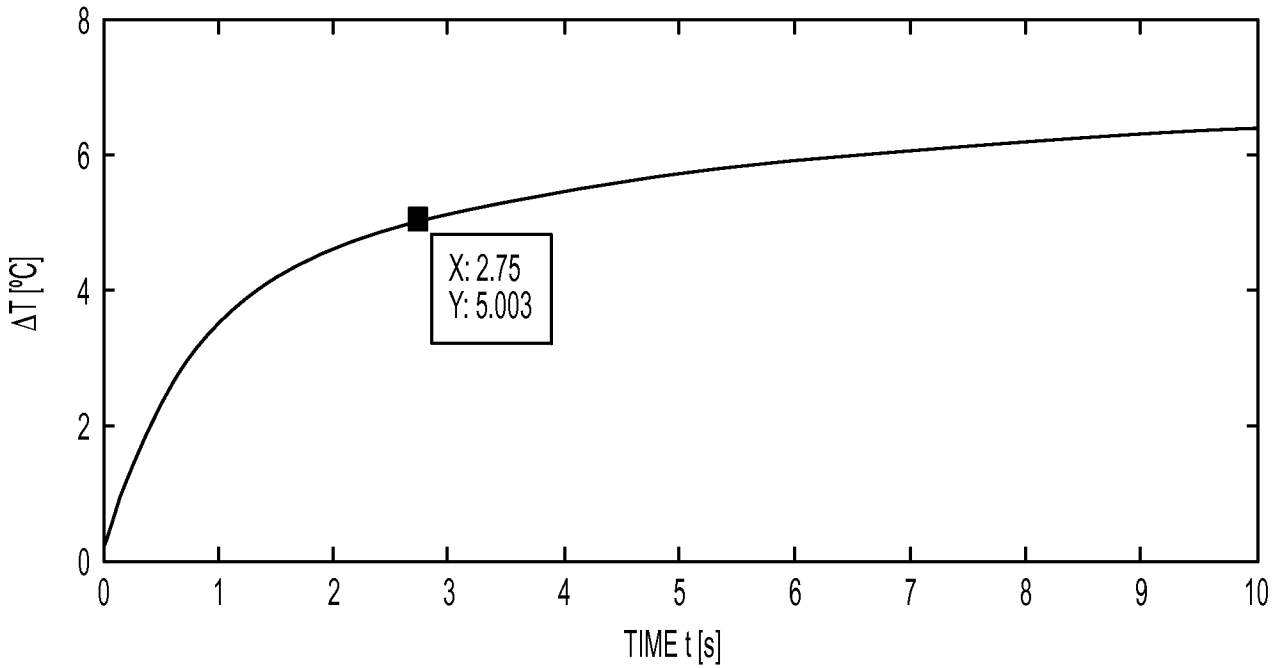

In FIGS. 3 and 4, graphs illustrate results of a thermal analysis applied to a heating arrangement as shown in FIG. 2. Curves 302-304 show temperature profiles over distance from the heated surface across an infinite slab of polyimide, here chosen as an approximation for ink/polyimide/ink layers. Each curve 302-304 represents the profile for times of 1, 3, and 5 seconds after the heater is turned on. Starting at x=0 (where x is indicated by arrow 219 in FIG. 2), the temperature profiles were split into 300 um wide sections 306-308 and averaged to approximate conditions in the layers.

The average temperatures of sections 306 and 308 respectively represent temperatures of ink in the two channels 206 and 210 of FIG. 2. This temperature difference is plotted as ΔT in FIG. 4, which indicates the temperature difference reaches 5° C. at 2.5 seconds. The temperature difference approaches a steady state value between 6 and 8° C. for t>10 sec. To avoid overheating of the wax, it may be desirable to only use a short pulse of heat just before the purge is going to start, and so for purposes of the following analysis, a 5° C. differential are assumed.

The viscosity of solid ink in an example ink jet configuration is about 10 mPa*s at the working temperature of 120° C., and the temperature dependence of viscosity around that operating point is −0.18 mPa*s/° C. Assuming the flow is laminar, the fluidic resistance is directly proportional to viscosity, and so increasing the temperature by 5° C. decreases the resistance by 9%. Consequently, given the temperature profile shown in FIG. 3, the flow velocity through the bypass channel 210 would be about 9% higher than flow though the primary channel 206, and thereby the bypass channel 210 would be a preferred path for bubbles. As noted above, it would take about three seconds to establish a temperature difference that would allow a 9-10% higher flow in the bypass.

In some cases (e.g., where cross-sectional areas normal to the flow are similar), the different flow velocities between paths 206, 210 may result in flow volume (e.g., volume of fluid per unit of time passing through the passageway) of the bypass channel 210 being greater than that of the primary channel 206. In some situations, it may be preferable that bypass flows be smaller than primary flows, e.g., to minimize an amount of ink sent to vent port, which may be discarded in some configurations. In reference now to FIG. 5, a schematic diagram illustrates a flow path 500 according to an example embodiment that results in a bypass flow volume that is lower than a primary flow volume.

The flow path 500 may be fabricated by stacking up pre-cut layers of material, e.g., sheet stainless steel. The path 500 includes an ink supply port 502 and an ink delivery port 504 fluidly coupled via a plurality of channels 506A-506C that collectively form a primary passageway 506. Junctions 508A-508C couple the channels 506A-506C to each other and to a bypass channel 510. The bypass channel 510 diverts bubbles away from the primary flow channel 506 to a vent port 514.

Each of the channels 506A-506C is configured to have an increasingly higher flow velocity V4-V2 the further away the channels are from the supply port 502. The bypass channel 510 has a higher flow velocity V1 than any of the channels 506A-506C. In this embodiment, the differing flow velocities are achieved by staggering the junctions, which varies channel lengths between the supply/inlet port 502 and exit ports 504, 514. All else being equal, a longer channel will have higher resistance to fluid flow, and thereby have lower flow velocity for same/similar pressure differentials between inlet port 502 and exit ports 504, 514.

The fluidic resistance of each channels 506A-506C, 510 may be designed so that at each junction 508A-508D there is a 1.2 times higher flow rate going to the next layer in relation to the flow that stays in the layer. For example, channels 506A-506C may pass 45%, 25%, and 14% of the flow, respectively, and the remaining 16% of the total flow goes through the bypass channel 510. Recombination of the channels 506A-506C at delivery port 504 amounts to 84% of the total incoming flow. Because of the highest flow velocity V1 in bypass channel 510, the bubbles would be induced to travel to the bypass channel 510. However, because flow is divided amongst multiple channels, the bypass flow accounts for only 16% of the total flow. This reduces the amount of ink that is ejected through the vent 514 during purging operations.

Figure 6:
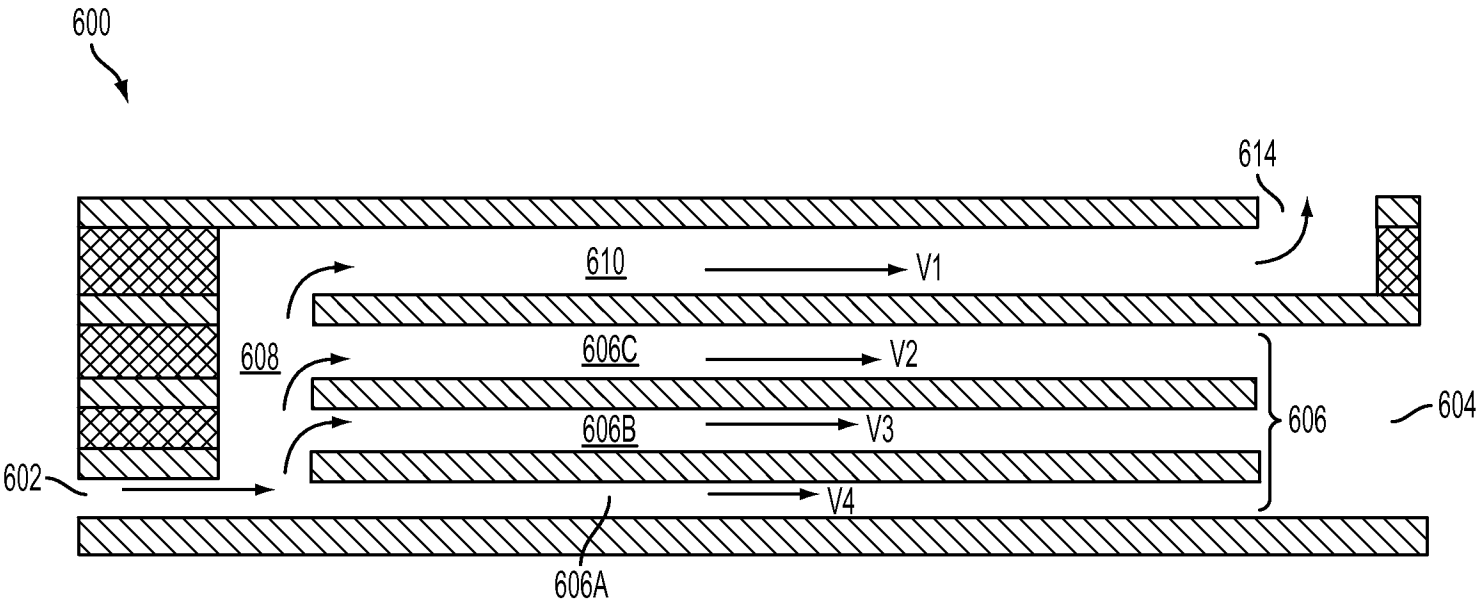
FIG. 6 is a perspective view of an inkjet manifold flow path using multiple channels according to another example embodiment.

It will be understood that any geometric or material property that affects flow rate or flow velocity can be used to influence migration of bubbles into a bypass channel instead of a primary channel. One alternate arrangement is shown in FIG. 6, which is a schematic diagram illustrating a flow path 600 according to another example embodiment. The flow path 600 may be fabricated by stacking up pre-cut layers of material, e.g., sheet stainless steel. The flow path 600 includes an ink supply port 602 and an ink delivery port 604 fluidly coupled via a plurality of channels 606A-606C that collectively form a primary passageway 606. Junction 608 couple the channels 606A-606C to each other and to a bypass channel 610. The bypass channel 610 diverts bubbles away from the primary flow channel 606 to a vent port 614.

Each of the channels 606A-606C is configured to have an increasingly higher flow velocity V4-V2 the further away the channels are from the supply port 602. The bypass channel 610 has a higher flow velocity V1 than any of the channels 606A-606C. In this embodiment, the differing flow velocities are achieved by increasing the height of the channels 606A-606C, 610, all of which have an approximately equal length between inlet port 602 and exit ports 604, 614. All else being equal, a narrower channel will have higher resistance to fluid flow, and thereby have lower flow velocity for same/similar pressure differentials between inlet port 602 and exit ports 604, 614. As with the embodiment shown in FIG. 5, the relative amount of flow through the bypass 614 can be significantly less than the primary channel 606, even though flow velocity/rate is higher through the bypass 614 than through individual channels 606A-606C.

Figure 5:
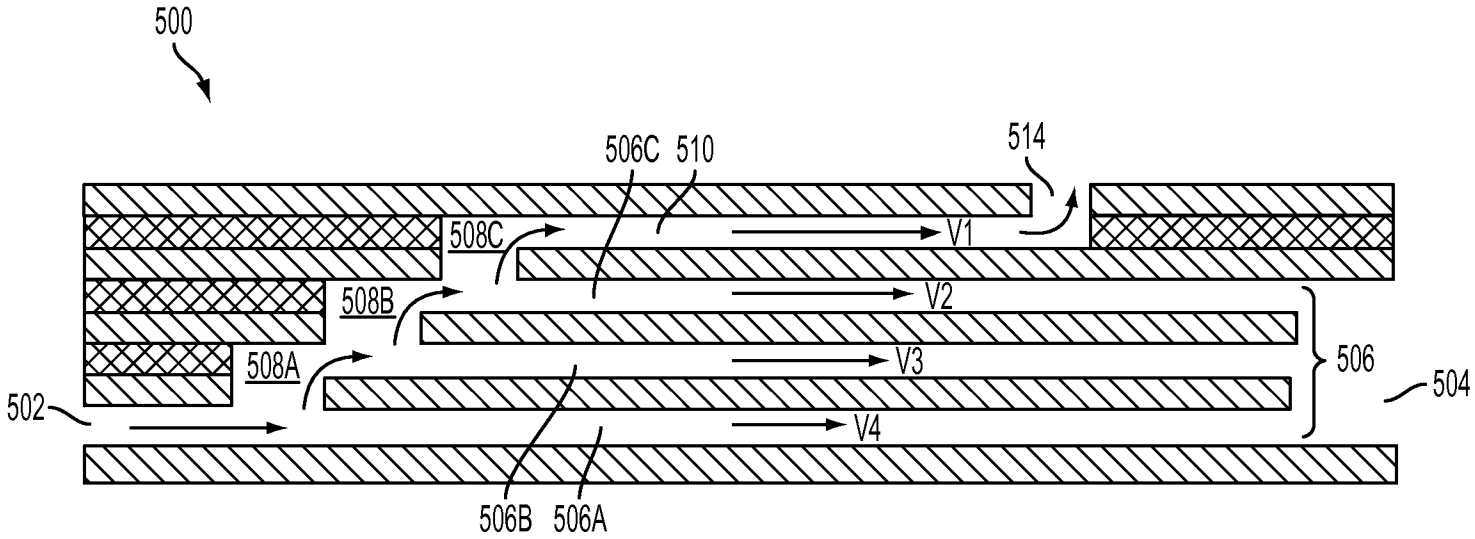
FIG. 5 is a perspective view of an inkjet manifold flow path using multiple channels according to another example embodiment.

It will be appreciated that the embodiments shown in FIGS. 5 and 6 may be combined with a heater as shown in FIG. 2. Using FIG. 5 as an example, a heating element may be placed proximate the bypass channel 510, which will reduce viscosity of ink in the channel 510 causing a further flow velocity increase in the channel. The combination of a heater and varying channel velocity may be used to strike a balance between channel complexity (e.g., reduce the number of primary passageway channels) and relative amount of ink sent through bypass to remove bubbles.

Figure 7:
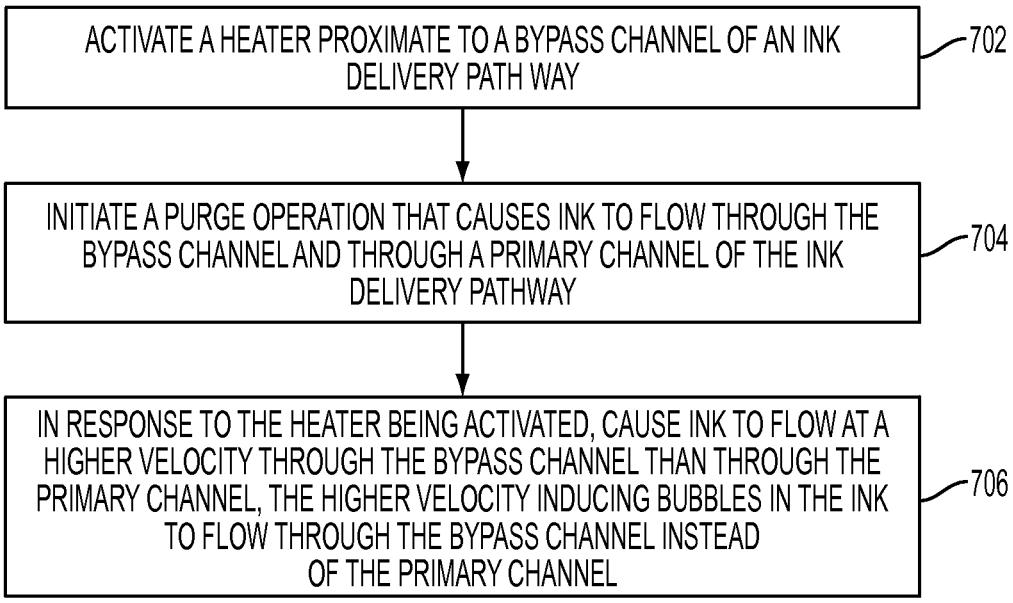
FIG. 7 is a flowchart showing a procedure according to an example embodiment.

In reference now to FIG. 7, a flowchart illustrates a procedure according to an example embodiment. The procedure involves activating 702 a heater proximate to a bypass channel of an ink delivery path way. A purge operation is initiated 704, the operation causing ink to flow through the bypass channel and through a primary channel of the ink delivery pathway. In response to the heater being activated, ink is caused 706 to flow at a higher velocity through the bypass channel than through the primary channel. The higher velocity induces bubbles in the ink to flow through the bypass channel instead of the primary channel.

Figure 8:
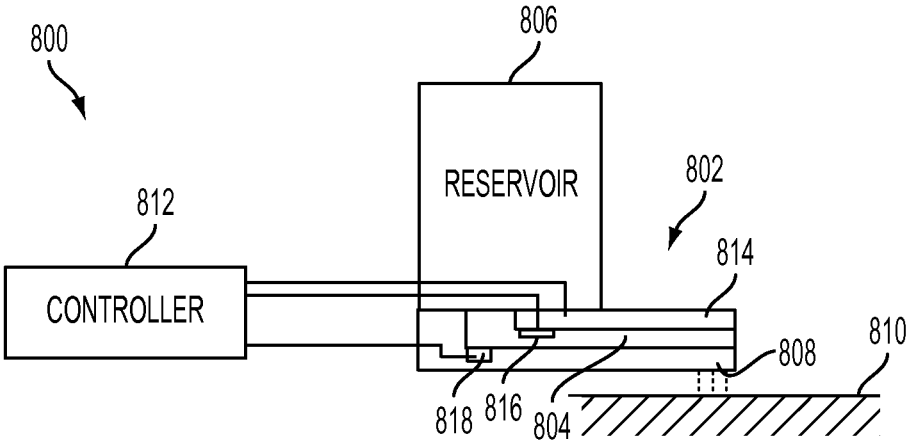
FIG. 8 is a block diagram of an apparatus according to an example embodiment.

In FIG. 8, a block diagram illustrates an apparatus 800 according to an example embodiment. The apparatus 800 includes a print head 802 with a flow path/manifold 804 having bypass and primary flow paths as described herein. The flow path 804 delivers ink from a reservoir 806 to ink jets 808 for application to a printing media 810 (or intermediary printing surface). The apparatus 800 includes a controller 812 that is capable of controlling various functions of the apparatus 800, e.g., via dedicated logic circuitry via execution of instructions via a special-purpose or general-purpose processing unit.

The controller 812 may be coupled to a heater 814 of the print head 802. The heater 814 may facilitate melting solid ink to facilitate flow through the flow path 804, and may be configured to induce a temperature differential such as shown in the example embodiment of FIG. 2. The controller 812 may also be coupled to a mechanical and/or thermal element 816 that facilitates selectably enabling a bypass of the flow path 804 to enable removal of bubbles via the bypass to a vent (not shown). The controller 812 may be coupled to a sensor 818 that detects bubbles, and in response thereto, selectably activate element 816 to block or un-block the bypass as appropriate.

The foregoing description of the example embodiments has been presented for the purposes of illustration and description. It is not intended to be exhaustive or to limit the embodiments to the precise form disclosed. Many modifications and variations are possible in light of the above teaching. For example, although embodiments are shown herein as parallel paths formed by cut outs in stacked plates, the embodiments may also be applicable to non-parallel channels, and to alternate formation of flow paths. For example, flow path structures may be formed using injection molding, casting, etching, micromachining, layer deposition, and other fabrication methods known in the art.

Any or all features of the disclosed embodiments can be applied individually or in any combination are not meant to be limiting, but purely illustrative. It is intended that the scope of the invention be limited not with this detailed description, but rather determined by the claims appended hereto.

What is claimed is:

1. An apparatus, comprising:

a bypass flow path between an ink supply port and a vent port;

a primary flow path between the ink supply port and an ink delivery port; and a heater configured to induce a first temperature in the bypass flow path that is higher than a second temperature of the primary flow path, wherein the first temperature reduces a viscosity of ink flowing in the first path such that a first flow velocity of the bypass flow path is higher than a second flow velocity of the primary flow path, and wherein the first flow velocity induces bubbles to travel via the bypass flow path instead of the primary flow path.

2. The apparatus of claim 1, further comprising a thermal insulator between the bypass and primary flow paths.

3. The apparatus of claim 1, wherein the ink delivery port comprises a plurality of exit ports, and wherein the primary flow path is coupled to the vent port downstream from the plurality of exit ports.

4. The apparatus of claim 1, wherein the primary flow path comprises two or more parallel channels coupled to each other by junctions, wherein one of the channels is parallel to and coupled to the bypass flow path by one of the junctions, wherein each of the two or more channels has a greater flow resistance than the bypass flow path.

5. The apparatus of claim 4, wherein a collective flow rate through the channels is greater than a flow rate through the bypass flow path.

6. The apparatus of claim 4, wherein the junctions are staggered relative to each other in a downstream direction so that lengths of the channels increase in relation to distances of the channels from bypass flow path, and wherein flow resistances of the channels are proportional to the lengths of the channels.

7. The apparatus of claim 1, wherein the apparatus comprises a plurality of stacked layers, and wherein the bypass and primary flow paths are formed as cutouts within the stacked layers.

8. The apparatus of claim 1, further comprising a mechanical flow blocking member that facilitates selectably blocking the bypass flow path.

9. The apparatus of claim 8, further comprising a sensor configured to detect the bubbles, and a controller coupled to the sensor and the mechanical flow blocking member, the controller configured to selectably block the bypass flow path in response to detecting the bubbles.

10. A method comprising:

activating a heater proximate to a bypass channel of an ink delivery path way; and initiating a purge operation that causes ink to flow through the bypass channel and through a primary channel of the ink delivery pathway, wherein the heater causes ink to flow at a higher velocity through the bypass channel than through the primary channel, and wherein the higher velocity induces bubbles in the ink to flow through the bypass channel instead of the primary channel in response to the purge operation.

11. The method of claim 10, wherein initiating the purge operation further comprises selectably enabling flow through the bypass channel for the purge operation, and selectably disabling flow through the bypass channel otherwise.

12. The method of claim 10, further comprising detecting the bubbles, and wherein the flow through the bypass channel is selectably enabled in response to detecting the bubbles.

* * * * *